US009361814B2

(12) United States Patent
Mallory et al.

(10) Patent No.: US 9,361,814 B2
(45) Date of Patent: Jun. 7, 2016

(54) BACKLIT SIGN EXHIBITING BRIGHTNESS AND COLOR UNIFORMITY

(71) Applicant: CoreLED Systems, LLC, Livonia, MI (US)

(72) Inventors: Derek Mallory, Plymouth, MI (US); Brian Wells, Grosse Pointe Farms, MI (US)

(73) Assignee: CoreLED Systems, LLC, Livonia, MI (US)

( * ) Notice: Subject to any disclaimer, the term of this patent is extended or adjusted under 35 U.S.C. 154(b) by 0 days.

(21) Appl. No.: 14/283,899

(22) Filed: May 21, 2014

(65) Prior Publication Data

US 2015/0339958 A1 Nov. 26, 2015

(51) Int. Cl.

| | |
|---|---|
| ***G09F 13/22*** | (2006.01) |
| ***G09F 13/04*** | (2006.01) |
| ***G09F 13/08*** | (2006.01) |

(52) U.S. Cl.

CPC ..... *G09F 13/04* (2013.01); *G09F 13/08* (2013.01); *G09F 13/22* (2013.01); *G09F 2013/222* (2013.01)

(58) Field of Classification Search

None

See application file for complete search history.

(56) References Cited

U.S. PATENT DOCUMENTS

| | | | | |
|---|---|---|---|---|
| 6,978,566 | B2 * | 12/2005 | Broelemann | 40/564 |
| 7,748,148 | B2 | 7/2010 | Reiland et al. | |
| 7,766,509 | B1 | 8/2010 | Laporte | |
| 8,210,722 | B2 | 7/2012 | Holder et al. | |
| 9,010,963 | B2 * | 4/2015 | Mallory | F21K 9/50 362/237 |
| 2011/0075428 | A1 * | 3/2011 | Chen | F21V 5/04 362/311.02 |
| 2012/0307454 | A1 | 12/2012 | Chou | |
| 2013/0042510 | A1 * | 2/2013 | Nall et al. | 40/541 |
| 2015/0176774 | A1 * | 6/2015 | Chen | G02B 19/0019 362/311.02 |

* cited by examiner

*Primary Examiner* — Joanne Silbermann
(74) *Attorney, Agent, or Firm* — Butzel Long

(57) ABSTRACT

A backlit sign exhibiting a uniform illumination intensity pattern is achieved in a structure having a light transmissive front panel, a back panel, and a plurality of backlight modules disposed on a surface of the back panel that faces the front panel, wherein the backlight modules are spaced apart in an array, and each module includes at least one LED and a lens member having a lens portion that collects light from the LED and redirects the light into a generally square illumination pattern on the front panel.

19 Claims, 6 Drawing Sheets

BACKLIT SIGN EXHIBITING BRIGHTNESS AND COLOR UNIFORMITY

CROSS-REFERENCE TO RELATED APPLICATIONS

Not applicable.

FIELD OF THE DISCLOSURE

This disclosure relates to backlit signs.

BACKGROUND OF THE DISCLOSURE

Backlit signs comprising light emitting diodes (LEDs) disposed in a cavity defined between a back plate and a light transmissive front plate on which or through which indicia can be displayed are well known. However, there remains a need for more efficient and uniform distribution of light from the LEDs to reduce or eliminate areas on the display surface of the sign that are overly bright (so called "hot spots") or too dark, while reducing the number of LEDs needed to achieve the desired uniformity of illumination, both in terms of intensity and color.

SUMMARY OF THE DISCLOSURE

A backlit sign in accordance with this disclosure includes a light transmissive front or display panel, a back panel, a plurality of backlight modules disposed on a surface of the back panel that faces toward the front panel, wherein the backlight modules are spaced apart on the back panel, and each module includes at least one LED and a lens member disposed over the LED. The lens member includes a base portion and a lens portion that projects from the base portion. Each lens portion is disposed over a respective one of the light emitting diodes to direct and uniformly distribute visible light from the LEDs toward the front panel. Indicia is provided on the inner or outer surfaces of the front panel, or on a light transmissive substrate located adjacent the front panel.

The indicia can be applied to either the front or outside surface of the front panel or to the rear or inside surface of the front panel. As an alternative, the indicia can be applied to a light transmissive substrate that is located between the front panel and the LEDs.

In certain embodiments, the backlight modules include two LEDs. The two LEDs of each of the backlight modules can be arranged together with a lens member having two lens portions to provide an illumination pattern that has a shape which is generally square with rounded corners. The two LEDs of each of the backlight modules can be spaced apart by a distance that facilitates the desired illumination pattern having substantially uniform brightness and color intensity.

The lens member can include a generally planar upper surface from which the lens portion project. The lens portions can have a cross-sectional shape in a plane parallel with the generally planar upper surface of the base portion that is generally square with rounded corners.

In certain embodiments of the disclosed backlit sign, a recess extends upwardly from a lower generally planar surface of the base portion of the lens member toward each of the lens portions. The recess can extend upwardly from the lower generally planar surface of the base portion of the lens member and terminate within the lens portion.

The cross-sectional dimension of each recess in a plane parallel with the generally planar upper surface of the base portion of the lens member can decrease or taper at increasing distances from the lower generally planar surface of the base portion. A portion of each recess that is furthest from the lower generally planar surface of the base portion can define a paraboloid.

The backlight modules can be arranged in an array of rows and columns in which the modules are evenly spaced apart with respect to both the rows and columns.

The spacings between backlight modules and the spacing between the lens members and the front panel can be adjusted so that the edges of the illumination patterns on the front panel from adjacent backlight modules abut one another with a minimum overlap or gap to provide uniform lighting intensity at the front panel, and/or to produce a composite illumination pattern that has a generally square shape with rounded corners.

DETAILED DESCRIPTION OF ILLUSTRATED EMBODIMENTS

Figure 1A:
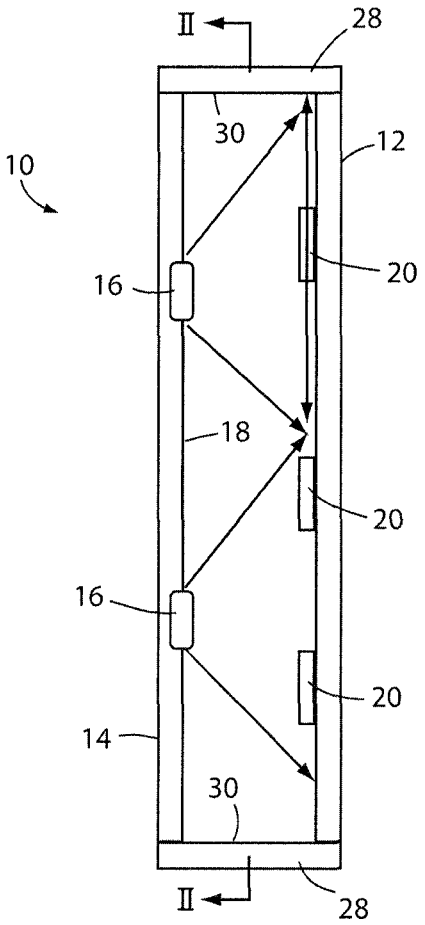
FIG. 1A is a vertical cross-sectional view of a backlit sign consistent with this disclosure, having indicia on the inner surface of the display panel.
Figure 1B:
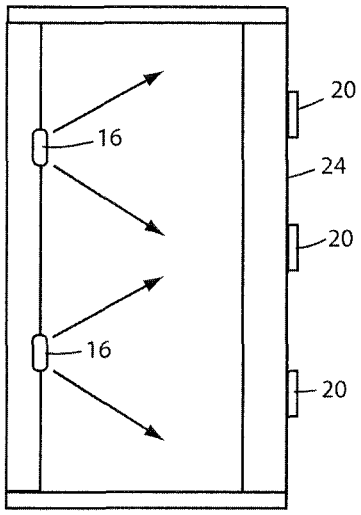
FIG. 1B is a vertical cross-sectional view of an alternative backlit sign in which the indicia is on the outer surface of the display panel.
Figure 1C:
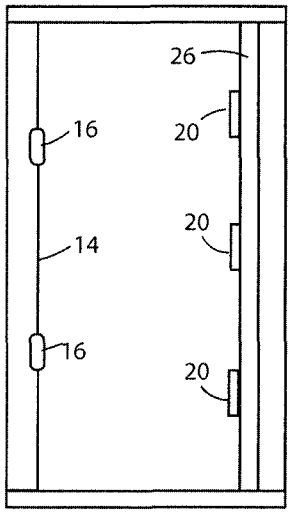
FIG. 1C is a vertical cross-sectional view of another alternative backlit sign in which the indicia is on a substrate disposed adjacent the display panel.

Shown in FIG. 1A is a cross-sectional view of backlit sign 10 having a light transmissive front panel 12 and a back panel 14. A plurality of backlight modules 16 are mounted on a side 18 of panel 14 that faces toward front panel 12. Indicia 20 is provided on the front panel 12, either on an inner surface 22 as shown in FIG. 1A, on an outer surface 24 as shown in FIG. 1B, or on a separate substrate 26 adjacent panel 12.

The indicia can be provided on either or both sides of substrate 26, and substrate 26 can be located on either side of front panel 12. Indicia 20 can be applied using any suitable printing technique or paint and/or dye application technique (e.g., silk screen technique).

The term "light transmissive" refers to a material having the ability to allow light in the visible wavelength range to impinge one side of the material, pass through the material, and be emitted from the side of the material opposite the side the light impinges. Optical transmissive material include transparent materials and translucent materials.

Backlit sign 10 can be provided with walls 28 that enclose the top, bottom and sides of the sign. Back panel 14 and/or walls 28 can be comprised of an opaque or light transmissive material. The inwardly facing surfaces 18 and 30 of panel 14 and walls 28 can be provided with a reflective material.

Figure 2:
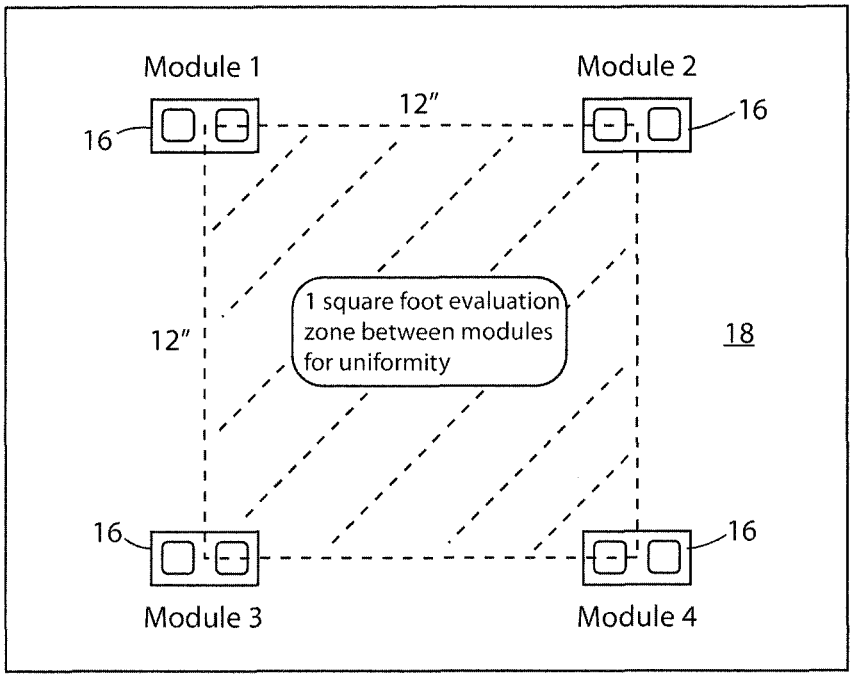
FIG. 2 is a cross-sectional view along lines II-II of FIG. 1.
Figure 3:
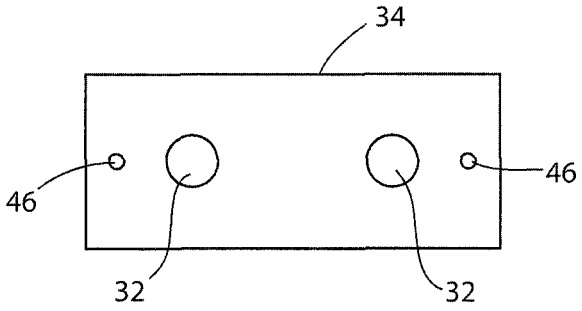
FIG. 3 is a top view of an LED fixture for a backlight module that can be mounted to a back plate of the backlit sign.
Figure 4:
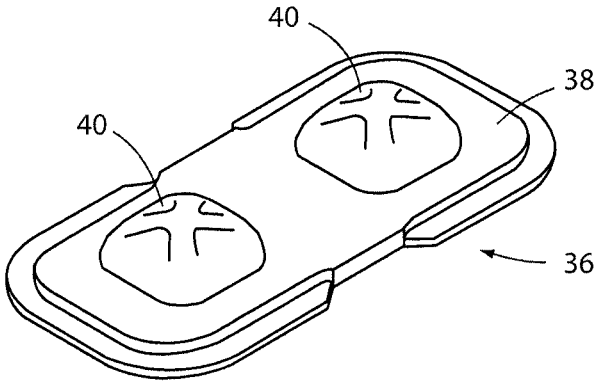
FIG. 4 is a perspective view of a lens member that can be used with the LED fixture of FIG. 3 to define a backlight module.
Figure 5:
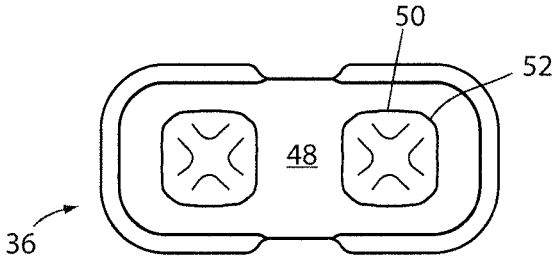
FIG. 5 is a top view of the lens member shown in FIG. 4.
Figure 6:
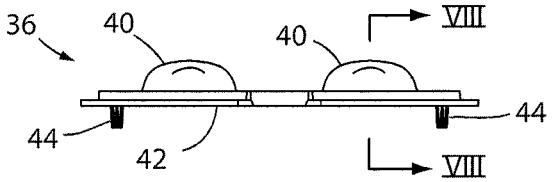
FIG. 6 is a side view of the lens member shown in FIG. 4.
Figure 7:
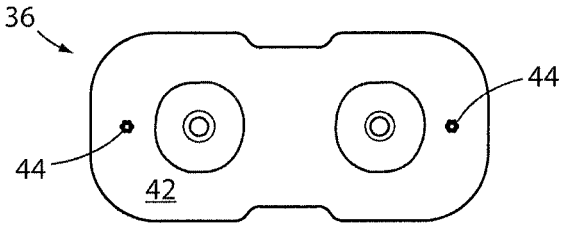
FIG. 7 is a bottom view of the lens member shown in FIG. 4.
Figure 9:
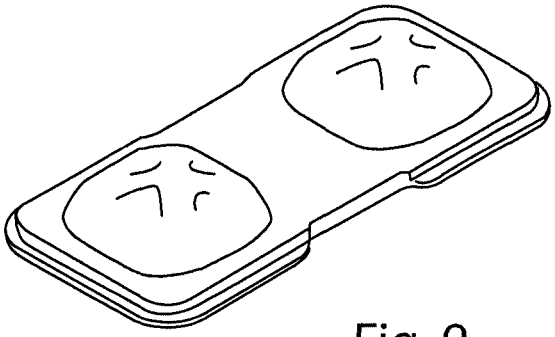
FIG. 9 is a perspective view of an alternative lens member that can be used with the LED fixture of FIG. 3 to define a backlight module.
Figure 10:
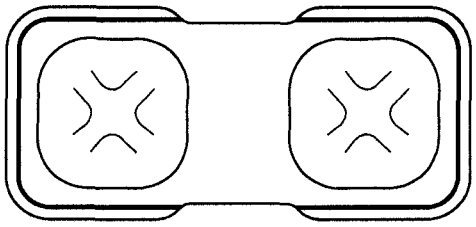
FIG. 10 is a top view of the lens member shown in FIG. 9.
Figure 11:
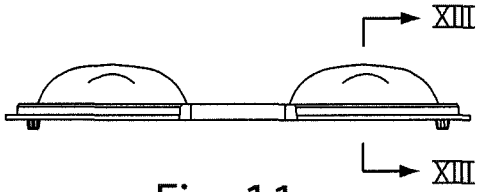
FIG. 11 is a side view of the lens member shown in FIG. 9.
Figure 13:
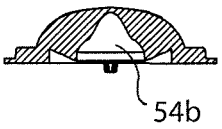
FIG. 13 is a cross-sectional view of the lens member of FIG. 9 as seen along lines XIII-XIII of FIG. 11.
Figure 12:
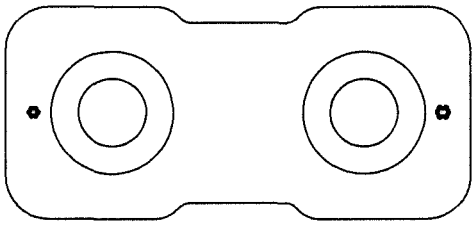
FIG. 12 is a bottom view of the lens member shown in FIG. 9.
Figure 14:
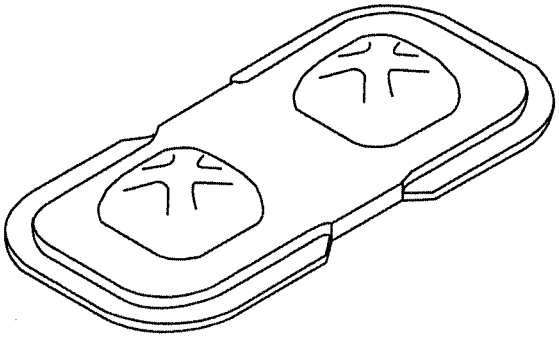
FIG. 14 is a perspective view of another alternative lens member that can be used with the LED fixture of FIG. 3 to define a backlight module.
Figure 15:
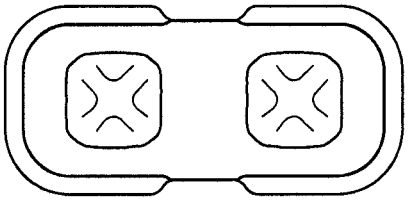
FIG. 15 is a top view of the lens member shown in FIG. 14.
Figure 16:
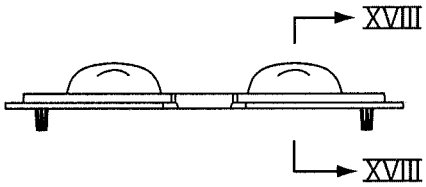
FIG. 16 is a side view of the lens member shown in FIG. 14.
Figure 18:
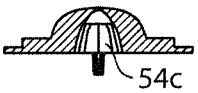
FIG. 18 is a cross-sectional view of the lens member shown in FIG. 14 as seen along lines XVIII-XVIII of FIG. 16.
Figure 17:
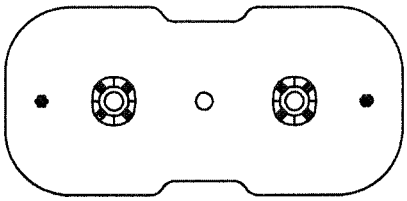
FIG. 17 is a bottom view of the lens member shown in FIG. 14.

Backlight module 16 can be spaced apart on back panel 14, such as illustrated in FIG. 2. Backlight module 16 includes two spaced apart light emitting diodes (LEDs) 32 mounted on a support structure 34 having suitable electrical contacts, conductive pathways, and the like (not shown) for providing power to the LEDs 32. A lens member 36 (FIGS. 4-17) is disposed over LEDs 32 to collect light emitted from the LEDs 32 and distribute the light in a uniform square pattern onto front panel 12. Lens member 36 includes a base portion 38 and two spaced apart lens portions 40 that project from base portion 38. Each lens portion 40 is positioned over a respective one of the LEDs 32. The center of each lens portion 40 can be positioned over the center of the corresponding LED 32. The bottom surface 42 of lens member 36 can be provided with locator pins 44 (FIGS. 7 and 8) that are received in openings or holes 46 provided in LED support structure 34 (FIG. 3). In an alternative embodiment, each module can include a single LED and a lens member having a single lens portion. The single LED modules may otherwise be similar to the described two LED modules.

Base portion 38 of lens member 36 has a generally planar upper surface 48 from which the lens portions 40 project. Each lens portion has a cross-sectional shape 50 (FIG. 5) in a plane parallel with the generally planar upper surface 48 of base portion 38 that is generally square with rounded corners 52. A recess 54*a* extends upwardly from a lower generally planar surface 56 of base portion 38 of lens member 36. Recess 54*a* extends upwardly from lower generally planar surface 56 a distance that exceeds the distance from surface 56 to upper surface 48. The cross-sectional area and dimensions of recess 54*a* decrease or taper from lower surface 56 toward upper surface 48, with a portion 60 furthest from lower surface 56 defining a paraboloidal volume (i.e., a three dimensional cavity in which each cross-section perpendicular to the surfaces 56 and 48 has a parabolic shape). The interior and exterior surfaces of lens portions 40 are configured to collect light from an LED 32 and direct it onto panel 12 in a generally square illumination pattern having rounded edges, allowing the backlight modules 16 to be arranged in an array of rows and columns in which the edges of adjacent illumination patterns abut to form a square or rectangular composite illumination pattern having substantially uniform intensity and color.

In the illustrated embodiment shown in FIG. 2, four backlight modules 16 are arranged in a two-by-two array to form a generally square illumination pattern. Depending on the choice of LEDs, the modules 16 can be positioned about 6 inches to about 18 inches apart in each direction (along the rows and columns), about 10 inches to about 15 inches apart in each direction, about 11 to about 13 inches apart in each direction, or about 12 inches apart (i.e., 11.5 inches to 12.5 inches) in each direction. Depending on the shape and dimensions of lens portions 40, and on the particular LEDs, front panel 12 and lens portion 40 can be spaced apart by a distance of from about 2 inches to about 6 inches, about 3 inches to about 5 inches, or about 3.5 inches to about 4.5 inches.

Figure 8:
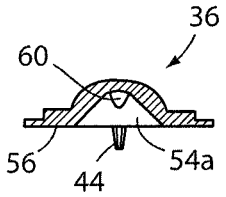
FIG. 8 is a cross-sectional view of the lens member of FIG. 4 as seen along lines VIII-VIII of FIG. 6.

FIGS. 9-13 and FIGS. 14-18, respectively, show two alternative embodiments in which the recesses 54*b* and 54*c* are shaped somewhat differently from the recess 54*a* of FIG. 8. However, all three embodiments produce a similar result of directing light from LED 32 into a generally square illumination pattern projected onto panel 12.

Figure 19:
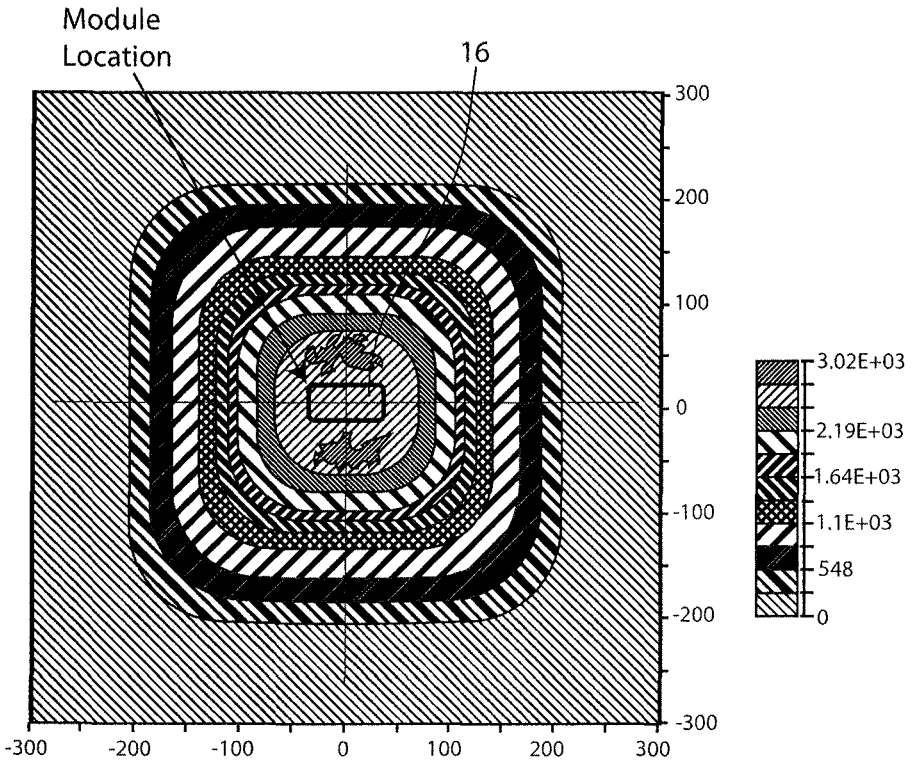
FIG. 19 is a light intensity pattern for a backlight module consistent with this disclosure.

FIG. 19 shows the illumination intensity pattern for light collected by a lens portion 40 as disclosed herein when projected onto a surface approximately 3.75 inches from the lens portion. The resulting pattern has a generally square illumination pattern exhibiting very uniform intensity.

Lens member 36 can be made of any optically clear material such as clear injection moldable polycarbonates (e.g., "Sabic Lexan 243" polycarbonate), polymethylacrylate, etc. Optically or light transmissive front panel 12 can be made of any clear (transparent) or translucent material (glass or plastic), such as polymethylacrylate (e.g., "Acrylite" sheets). The remaining components (e.g., back panel 14, walls 30, etc.) can be made of generally any structurally suitable material.

Suitable LEDs include Nichia NF2W7S7AT-V1 and NS6W183BT, Cree XBD, and Oslon SSL.

Computer simulations suggest that color uniformity comparable to intensity uniformity can be expected.

The use of two LEDs in each module 16 provides a significant cost advantage by achieving a desired illumination intensity using two lower intensity LEDs having a total cost lower than a comparable higher intensity single LED.

What is claimed is:

1. A backlit sign, comprising:

a light transmissive front panel;

a back panel;

a plurality of backlight modules mounted on a side of the back panel that faces the front panel;

indicia on the front panel or on a light transmissive substrate disposed adjacent the front panel;

wherein the backlight modules are spaced apart on the back panel, each module including at least one light emitting diode and a lens member disposed over the light emitting diode, the lens member having a base portion having a generally planar upper surface and a lens portion projecting from the base portion, the lens portion disposed over the light emitting diode and having a cross-sectional shape in a plane parallel with the generally planar upper surface of the base portion that is generally square with rounded corners to direct and distribute visible light from the light emitting diode toward the front panel in a generally square pattern, whereby the backlight modules are arranged in an array of rows and columns in which edges of adjacent illumination patterns from the modules abut to form a square or rectangular composite illumination pattern having substantially uniform color and intensity.

2. The backlit sign of claim 1, in which the light transmissive front panel is at least partially transparent to visible light.

3. The backlit sign of claim 1, in which the light transmissive front panel is at least partially translucent to visible light.

4. The backlit sign of claim 1, in which the indicia is printed on a front side of the front panel.

5. The backlit sign of claim 1, in which the indicia is printed on a back side of the front panel.

6. The backlit sign of claim 1, in which the indicia is printed on a transparent or translucent substrate disposed adjacent the front panel.

7. The backlit sign of claim 1, in which each module includes two spaced apart light emitting diodes and each lens member includes two spaced apart lens portions disposed over the corresponding light emitting diodes.

8. The backlit sign of claim 7, in which the two light emitting diodes of each module are spaced apart by a distance of from about 15 mm to about 40 mm.

9. The backlit sign of claim 7, in which the two light emitting diodes of each module are spaced apart by a distance of from about 20 mm to about 30 mm.

10. The backlit sign of claim 1, in which a recess extends upwardly from a lower generally planar surface of the base portion of the lens member into each lens portion.

11. The backlit sign of claim 10, in which each recess extends upwardly from the lower generally planar surface of the base portion of the lens member a distance that exceeds a distance between the lower generally planar surface of the base portion of the lens member and generally planar upper surface of the base portion of the lens member.

12. The backlit sign of claim 11, in which a cross-sectional dimension of each recess in a plane parallel with the generally planar upper surface of the base portion of the lens member decreases at increasing distance from the lower generally planar surface of the base portion.

13. The backlit sign of claim 12, in which a portion of each recess furthest from the lower generally planar surface of the base portion defines a paraboloid.

14. The backlit sign of claim 1, in which the backlight modules are arranged in rows and columns, and are spaced apart by a distance of from about 6 inches to about 18 inches in each row, and a distance of from about 6 inches to about 18 inches in each column.

15. The backlit sign of claim 1, in which the backlight modules are arranged in rows and columns and are spaced apart by a distance of from about 10 inches to about 15 inches in each row, and a distance of from about 10 inches to about 15 inches in each column.

16. The backlit sign of claim 1, in which the front panel and the lens portions of the lens members are spaced apart by a distance of from about 2 inches to about 6 inches.

17. The backlit sign of claim 1, in which the front panel and the lens portions of the lens members are spaced apart by a distance of from about 3 inches to about 5 inches.

18. The backlit sign of claim 1, in which the light emitted diodes from each module provides an illumination pattern having a generally square shape with rounded corners.

19. The backlit sign of claim 1, in which the plurality of backlight modules are arranged in an array that produces a composite illumination pattern having a generally square shape with rounded corners, and wherein a graph of light intensity versus distance from a center of the array has a wide central plateau region in which light intensity varies by less than 30% and narrower opposite edge regions in which the light intensity rapidly decreases by more than 90%.

* * * * *